United States Patent [19]

Thomas et al.

[11] 3,940,328

[45] Feb. 24, 1976

[54] RECONSTRUCTED OR REPAIRED ELECTRODE STRUCTURE

[75] Inventors: Vaselios H. Thomas, Florence, Ala.; Gerald R. Pohto, Mentor, Ohio

[73] Assignee: Electronor Corporation, Panama City, Panama

[22] Filed: Apr. 11, 1974

[21] Appl. No.: 459,923

[52] U.S. Cl. ..... 204/283; 204/252

[51] Int. Cl.[2] ..... C10G 19/00; C10G 17/00

[58] Field of Search ..... 204/252, 263, 266, 283

[56] References Cited

UNITED STATES PATENTS 3,591,483 7/1971 Loftfield et al. ..... 204/252

*Primary Examiner*—T. M. Tufariello

*Attorney, Agent, or Firm*—Hammond & Littell

[57] ABSTRACT

Repaired electrodes for use in diaphragm cells, electrowinning cells and the like comprising an elongated supporting riser having at least a surface coating of valve metal, at least a portion of a generally planar dimensionally stable previously used coated active electrode member bonded to said riser coating, a generally planar electrode member having a new electrocatalytic coating thereon secured to at least one of said riser coating or a portion of said previously used electrode.

15 Claims, 10 Drawing Figures

RECONSTRUCTED OR REPAIRED ELECTRODE STRUCTURE

THE PRIOR ART

U.S. Pat. No. 3,591,483 discloses the construction of a diaphragm-type electrolysis cell utilizing dimensionally stable anodes having a conductive, electrocatalytic coating thereon, which are connected to the cell base and a power supply source by means of a valve metal or a copper cored valve metal riser or conductor bar. In use, these anodes may be damaged by short circuits, physical distortion, coating wear and many other causes and are returned to the anode shop for repair and recoating.

The anode working face is usually constructed from expanded titanium mesh, titanium rods or titanium sheet material having a conductive, electrocatalytic coating thereon and is welded directly to the anode riser or conductor bar. If the anode or the coating became damaged or worn, it was considered necessary to entirely remove the anode from the anode riser and then repair and recoat the anode, before replacement of the repaired or recoated anodes in an electrolysis cell. The recoating requires heating the working face from 300° C to 500° C to cause the thermal decomposition of the coating material and to fix the coating on the anode face and if the anode face is welded to the riser or conductor bar before this heating, there is considerable distortion of the anode working face or destruction of the riser due to unequal heating of the working face and the riser and unequal expansion and contraction between these parts. Multiple coats are usually applied with heating between each coat, which multiplies the problem.

The risers or conductor bars are usually copper cored titanium tubes which are expensive and it is advantageous to be able to repair and/or recoat a previously used anode without destruction of the anode risers or conductor bars. However, the heat required for the thermochemical decomposition of the coating leads to considerable distortion of the anode faces which in the electrolysis cells must be substantially flat, since the copper cored riser acts as a "heat sink" and causes distortion of the recoated anodes faces.

OBJECTS OF THE INVENTION

One object of this invention is to provide a method for recoating, repairing or reconstructing electrodes of the type herein described which overcomes the above disadvantages and which considerably reduces the amount of time needed to effect repairs to damaged or worn anodes.

Another object of the invention is to provide as a product of manufacture, a reconstructed or repaired electrode for use in a diaphragm-type electrolytic cell and for other purposes comprising the previously used riser or conductor bar removed from an electrolysis cell, joined to a portion of the previously used electrode face and a second electrode face bonded to said electrode riser or conductor bar or said previously used electrode face.

A further object of the invention is to provide a method for recoating a dimensionally stable electrode by welding a new coated dimensionally stable electrode face to an existing damaged but inactive electrode.

Other objects and advantages of the invention will become apparent as this description proceeds.

DESCRIPTION OF THE INVENTION

This invention provides reconstructed or repaired electrodes, preferably anodes, for use in a diaphragm-type electrolysis cell or in other electrolysis cells in which the previously used riser for the electrodes are used without destruction of said risers and in which a new coated electrode face is secured to a previously used electrode face or to the previously used riser.

This invention is also directed to a method for reconstruction or repair of an electrode assembly which comprises an electrode riser bonded to a first electrode means or face and bonding a second electrode means or face to at least one of said electrode riser or said first electrode face.

The accompanying drawing illustrates several embodiments of the new electrode and of methods of making it.

FIG. 1 shows the electrode assembly used in an electrolysis cell according to U.S. Pat. No. 3,591,483;

FIG. 2 shows a side view and partial cut-away view of the prior art electrode assembly of FIG. 1;

FIG. 2*a* is a plan view of the electrode assembly of FIGS. 1 and 2;

Figure 9:
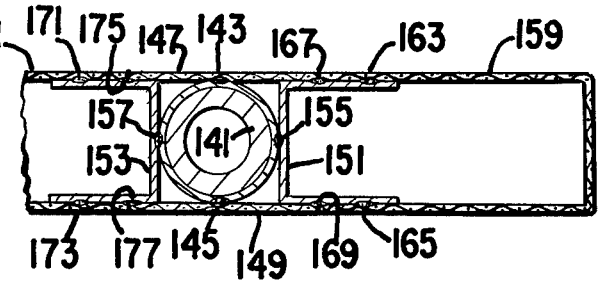
Figure 10:
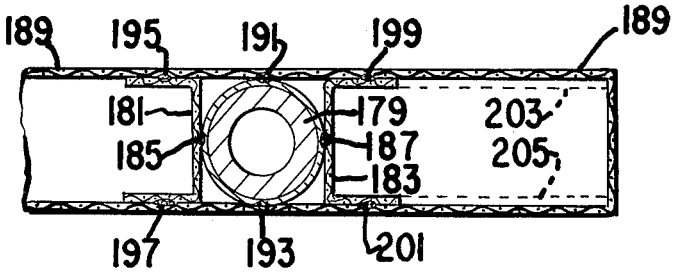

FIG. 9 shows another embodiment of the invention in which a second anode envelope or face is bonded to a portion of the first anode face with a stiffener means bonded to a portion of said second anode face and to the anode riser; and FIG. 10 shows an embodiment of the invention in which a second anode envelope or face is bonded to a portion of a first anode envelope or face and to the previously used anode riser or conductor bar.

The electrode riser is preferably a previously used anode conductor bar similar to the construction described in U.S. Pat. No. 3,591,483. These risers are usually constructed of a valve metal tube, such as titanium or tantalum and have a copper, sodium or aluminum core inside.

The dimensionally stable electrodes are preferably dimensionally stable anodes which comprise an anode face having an electrocatalytic electrically conductive surface or coating thereon, as described in U.S. Pat. No. 3,684,543.

When a dimensionally stable anode is in need of reconstruction or repair or a portion of the coating on the working face has become inactive after a period of use in an electrolysis cell, the damaged or inactive anode is usually returned from the cell house to the anode plant for repair or recoating or both. For this repair according to this invention, a portion of the first electrode working face is trimmed away, leaving the remainder still welded to the electrode riser. In some cases, it may be desirable to leave the original anode working face intact on the anode riser. A second electrode means having a coated surface which is active, is then secured to the anode riser or the previously used anode working face or both, preferably by welding.

While only one repair of an originally used anode will be described herein, it will be understood that the said anodes may undergo repair several times as long as the original anode riser can still be used, or as long as a portion of the original anode face remains useful, to which a new electrocatalytically coated anode working face may be connected.

It is sometimes preferable to add a stiffener means to the repaired or reconstructed electrode assembly in order to provide additional strength, flatness, shape control and greater electrical conductivity. The stiffener means can be a U-shaped titanium insert or it may be in the shape of a flat splice bar. The stiffener means is connected with at least one support means selected from the group comprising the electrode riser and the first electrode working face. During the bonding step, the stiffening means is bonded into electrically conductive contact with either the anode riser or a portion of the previously used anode working face, or both.

Figure 1:
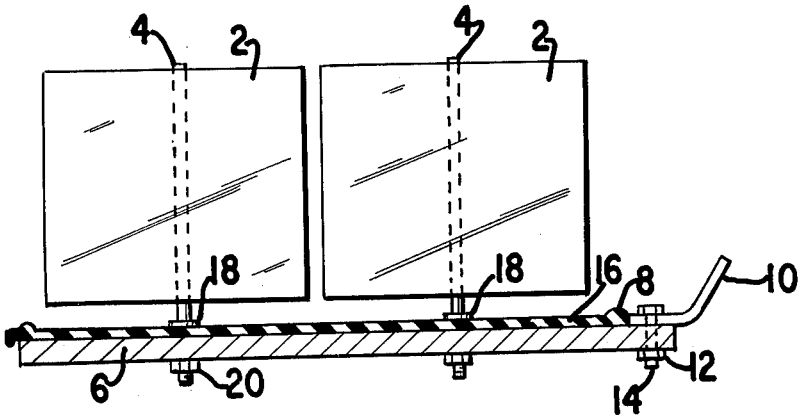

FIG. 1 discloses a prior art electrode assembly in which a pair of dimensionally stable anode working faces 2 are attached by means of anode riser or conductor bar 4 to the base 6 of a diaphragm chlorine electrolysis cell (now shown). The power supply lead 10 is attached to the cell base, for example, by means of a nut 12 and bolt 14. A non-conductive neoprene or rubber sheet 16 covers the cell base. The anode faces 2 are bonded to the anode risers 4 by welding and the risers or conductor bars 4 extend through the sheet 16 and the cell base 6 and are fastened to the cell base by means of a flange 18 and a nut 20.

Figure 2:
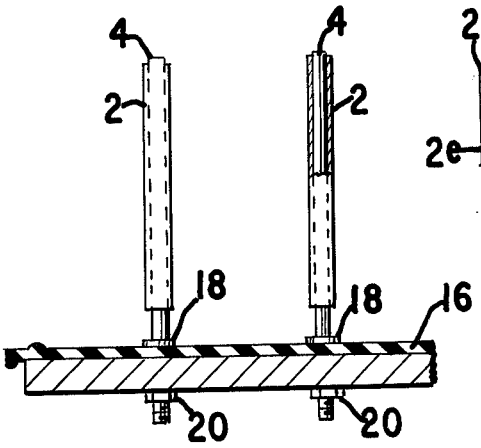

FIG. 2 is a side view showing the dimensionally stable anode working faces 2 attached to anode risers 4.

Figure 2A:
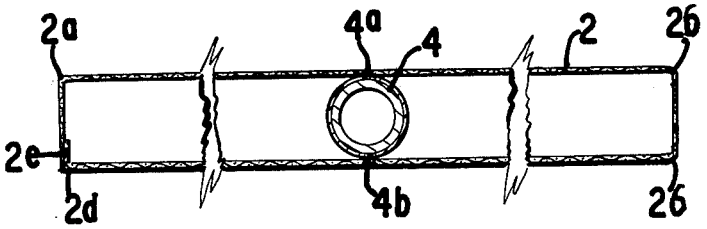

FIG. 2*a* is a plan view of the copper cored titanium riser 4 and anode working faces 2 in the form of a rectangular envelope. The envelope is formed by first coating a flat reticulated sheet of titanium with the desired electrocatalytic coating which is subjected to heating to effect thermal decomposition of the coating ingredients and fixing on the titanium base and is then bent at the corners 2*a*, 2*b*, 2*c* and 2*d* into a rectangular shape and the meeting portions welded along the line 2*e*. This coated envelope is then slid onto the copper cored riser 4 and welded to the riser along the lines 4*a* and 4*b*, after which it is ready for insertion into an electrolysis cell as described in connection with FIGS. 1 and 2. If the weld lines 4*a* and 4*b* are broken by removing the previously used anode envelope from the riser 4, the titanium coating on the copper core is usually damaged, exposing the copper core so that the riser cannot be reused in the corrosive conditions in an electrolysis cell. The electrocatalytic coating may be applied to and fixed on the anode faces 2, 2*a*, 2*b*, 2*c* and 2d according to the processes described in U.S. Pat. Nos. 3,632,498 or 3,711,385.

Figure 3:
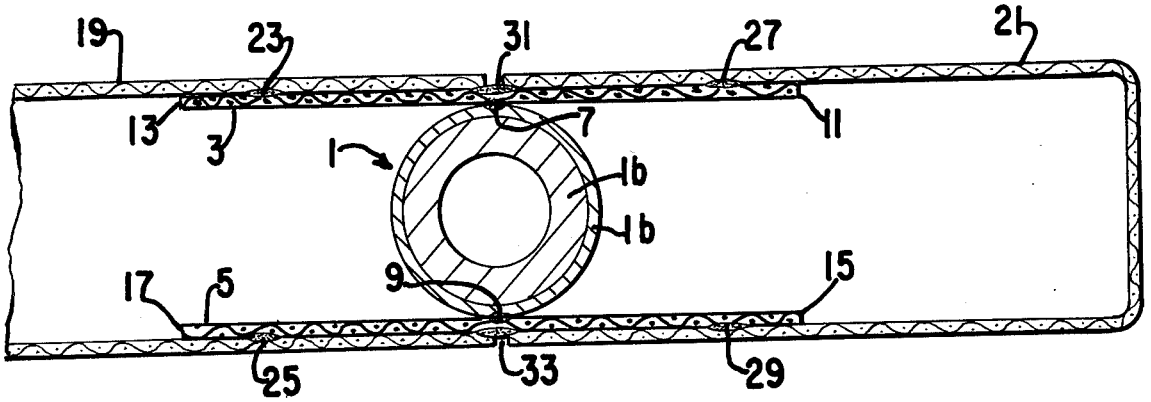
FIG. 3 shows one embodiment of the invention in which a second anode face or envelope is welded to a portion of a first anode face or envelope.

FIG. 3 shows an embodiment of this invention in which a second anode envelope or working face 19 is bonded to a portion of the first anode envelope or working faces 3 and 5. The anode riser 1 is comprised of an annular core 1*a* of copper, aluminum or other highly conductive metal inside a valve metal covering 1*b*. However, it is to be understood that the core may be of solid metal resistant to electrolysis cell conditions throughout its length. Portions 3 and 5 of a first dimensionally stable anode working face remain welded to the anode riser 1 at points 7 and 9. These first anode portions or working faces may be constructed from an expanded metal mesh or from metal rods. These first anode portions or working faces 3 and 5 are trimmed off at points 11, 13, 15 and 17.

Two new previously coated and baked anode envelopes or working faces 19 and 21 are secured to the previously used anode working faces by welding to the original portions 3 and 5. Envelope 19 is spot welded to portion 3 at 23 and to portion 5 at 25, while envelope 21 is welded to portion 3 at 27 and to portion 5 at 29. Gaps 31 and 33 between the ends of the envelopes 19 and 21 may be closed by welding the end of the envelopes or working faces 19 and 21 together and to the portions 3 and 5 of the first anode portions or working faces.

Figure 4:
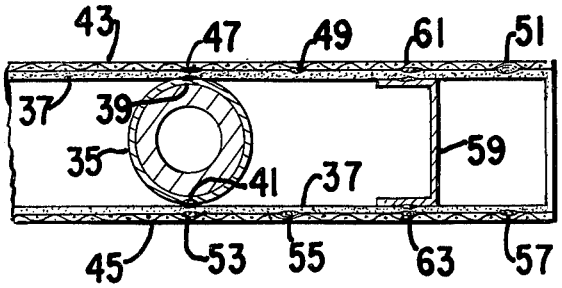
FIG. 4 shows a second embodiment of the invention in which a second anode face is welded to a first anode face with stiffener means welded therebetween.

FIG. 4 shows a further embodiment of the invention in which a new coated anode envelope or working faces 43 – 45 are placed over the previously used anode working faces 37 and welded to a first anode envelope or working faces 37 and a stiffener 59 is welded between the previously used anode working faces. The original anode envelope or working faces 37 are welded to the anode riser 35 at points 39 and 41, and the original anode envelope is left unchanged in the recoating or repair illustrated in FIG. 4. The second anode portions or working faces 43 and 45 are welded over said first anode faces at 47, 49, 51, 53, 55 and 57. Welds 49 and 55 are added for extra strength and for greater electrical conductivity. Titanium U-shaped stiffeners 59 may be inserted inside the original envelope faces and welded to both the first envelope or face and the second envelope or face at 61 and 63. The stiffener means 59 provide greater strength, flatness, shape control and greater electrical conductivity. Stiffeners 59 may be used at both the right and left side of the riser 35.

Figure 5:
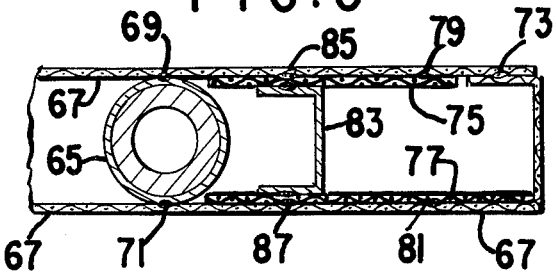
FIG. 5 shows a third embodiment of the invention in which a portion of a second anode envelope or face is welded to a first anode envelope or face with stiffener means welded therebetween.

FIG. 5 shows an embodiment of the invention in which a portion of a coated second anode working face 75 –77 is welded to the inside of the first anode envelope or working faces 67 with stiffeners 83 welded between the inserts 75 and 77. Anode riser 65 which may be copper cored titanium is welded to the original anode working faces 67 at 69 and 71. The meeting ends of anode 67 are welded together at 73. The original anode is otherwise left unchanged. Inserts 75 and 77 are positioned inside the original anode envelope 67 at one or both sides of the riser or conductor bar 65, and are welded therein as described previously. Prior to welding the inserts 75 and 77 inside the original envelope or working face 67, these inserts are coated with an electrocatalytic coating which is baked on the inserts. To provide the required flatness of the finished envelope, U-shaped stiffener means 83 are placed inside the mesh inserts 75 and 77 and welded to both the old anode portions 67 and the new anode portions 75 – 77 at 85 and 87.

Figure 6:
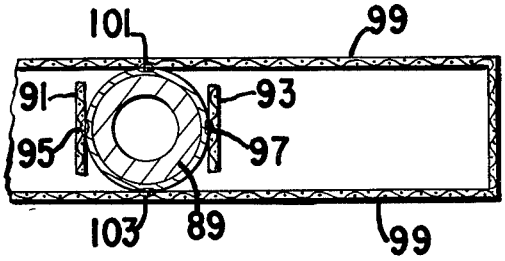
FIG. 6 shows a fourth embodiment of the invention in which a second anode envelope or face is welded to a previously used anode riser which has been rotated 90° from its position in the previously used anode working faces.

FIG. 6 shows another embodiment of the invention in which portions 91 and 93 of the old anode working face are left on the anode riser or conductor bar 89 and the bar rotated 90° and a new electrocatalytically coated anode envelope 99 is welded on to the previously used anode riser. Portions 91 and 93 of the original envelope or face remain welded to the riser 89, at points 95 and 87, so that the original welds are not broken and no damage is done to the titanium coating on the riser. The new envelope or faces 99 are welded to the riser 89 at 101 and 103.

Figure 7:
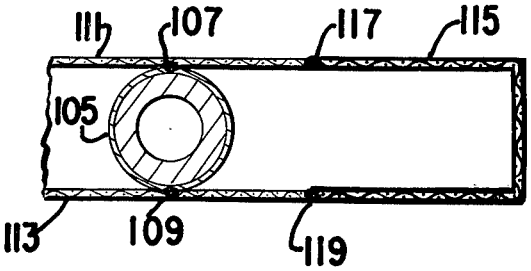
FIG. 7 shows another embodiment of the invention in which a portion of a second anode envelope or face is welded to a portion of a first anode envelope.

FIG. 7 shows another embodiment of the invention in which portions of a second anode envelope 115 are welded to portions of the previously used anode envelope working faces 111 – 113, welded to riser or conductor bar 105 at points 107 and 109 of the original dimensionally stable anode. Portions 111 and 113 are trimmed down to the approximate size shown. Portions 115 of a second anode envelope working face are butt-welded at 117 and 119 to original anode portions 111 and 113. New portions 115 may be added at either or both sides of the riser 105 and may replace greater or smaller area of the portions 111 and 113.

Figure 8:
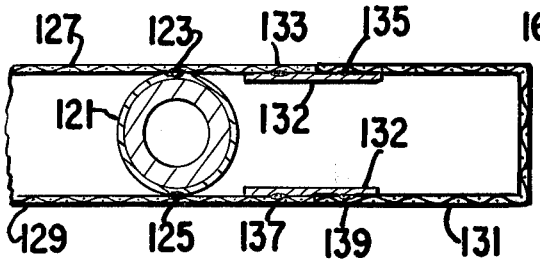
FIG. 8 shows a further embodiment of the invention in which a portion of a second anode envelope or face is joined to a portion of a first anode envelope by means of splice bars.

FIG. 8 shows a further embodiment of the invention in which previously coated portions 131 of a new anode envelope working faces are welded to portions 127 – 129 of the previously used anode envelope working faces by precoated titanium splice strips 132. Anode riser 121 is welded to portions 127 – 129 of the original anode envelope or face at 123 and 125. The portions 127 and 129 having been cut down to the size necessary to remove any damaged portions of the previously used anode. After portions 131 have been juxtaposed to portions 127 and 129, flat splice stiffener strips 132 are welded both to portion 131 and to portions 127 and 129 at 133, 135, 137 and 139. The portions 131 may be added at either the right or left of riser 121 or both.

FIG. 9 shows an embodiment of the invention in which new precoated anode envelope working faces 159 and 161 are welded to portions 147 and 149 of the previously used anode envelopes or working faces and stiffeners 151 and 153 are inserted inside the original envelope walls 147 and 149. Portions 147 and 149 of the original anode face are welded to the anode riser 141 at 143 and 145. The original anode envelopes or working faces are trimmed off to the extent necessary to remove damaged portions of the previously used anode. The stiffener channels 151 and 153 are welded to anode riser 141 at points 155 and 157. These stiffener channels provide greater rigidity and better electrical conductivity. In this embodiment, the added portion 159 is welded to stiffener means 151 at 163 and 165 and to the original anode portions 147 and 149 at points 167 and 169. The other added anode portion 161 is welded to stiffener means 153 at 171 and 173 and is also welded to both the stiffener means and to the original anode portions 147 and 149 at 175 and 177.

FIG. 10 shows a further embodiment of the invention in which the previously coated and baked added anode envelope or working face is bonded to a portion of the previously used anode envelope and to the anode riser. In this embodiment, the original portions 181 and 183 of the previously used anode envelope or face are trimmed off sufficiently to allow the metal in the original envelope to be folded back into U-shaped members 181 and 183 and the riser 179 with portions 181 and 183 thereon welded to original anode at 185 and 187 is rotated 90° as shown. A second anode envelope or face 189 is positioned as shown and welded at 191 and 193 to the anode riser 179 and to original anode portions 181 and 183 at 195, 197, 199 and 201.

An optional method of construction for this embodiment would be to fold the original anode portions 181 and 183 as shown by dash lines 203 and 205 on each side of the riser 179 and if desired weld the new envelope or faces 189 to the extensions 203 and 205 at as many points as desired.

In each of the embodiments the added valve metal portions in reticulated mesh, rod or other forms are provided with an electrically conducting electrocatalytic coating which is applied and baked on as described, for example, in U.S. Pats. Nos. 3,632,498 and 3,711,385, so that the reconstructed and recoated anodes do not have to be heated after the added portions are attached to the anode risers or the portions of the previously used anode envelopes or working faces which are attached to the risers.

The invention has the advantages that the anode can be repaired without entirely removing the previously used anode envelopes or working faces from the anode riser, or breaking the welds between the anode riser and the previously used anode working faces so that there is no damage to the more expensive anode risers and/or to the portions of the anode envelopes or working faces which are reused and no distortion of the new anode faces due to heating after attachment to the previously used anode working faces. There is no damage to the anode risers and there is a considerable reduction in the time needed to repair or to reconstruct a previously used anode.

Although the present invention has been described in connection with a few preferred embodiments thereof, variations and modifications may be resorted to by persons skilled in the art without departing from the principles of the invention or the scope of the accompanying claims.

What is claimed is:

1. A repaired electrode comprising an elongated supporting riser having at least a surface coating of valve metal, at least a portion of a generally planar dimensionally stable previously used coated active electrode member bonded to said riser coating, a generally planar electrode second member having a new electrocatalytic coating thereon secured to at least one of said riser coating or a portion of said previously used electrode member.

2. The electrode of claim 1 wherein previously used electrode member is an entire electrode envelope or a portion thereof.

3. The electrode of claim 1 wherein the second electrode member is an entire electrode envelope or a portion thereof.

4. The electrode of claim 1 wherein the two electrode members are made of a valve metal.

5. The electrode of claim 1 wherein the second electrode member is bonded solely to said riser coating.

6. The electrode of claim 1 wherein the second electrode member is bonded solely to the previously used electrode member.

7. The electrode of claim 1 wherein the second electrode member is bonded both to the riser coating and the previously used electrode member.

8. The electrode of claim 1 further comprising stiffener means bonded to at least one of said riser, said previously used electrode member or said second electrode member.

9. The electrode of claim 1 wherein said stiffener means is bonded to said riser and said previously used electrode member.

10. The electrode of claim 1 wherein said stiffener means is bonded to said riser and said second electrode member.

11. The electrode of claim 1 wherein said stiffener means is bonded to said previously used electrode member and the second electrode member.

12. The electrode of claim 1 wherein said stiffener means is bonded to said riser, said second electrode member and said previously used electrode member.

13. The product of claim 1, in which said stiffener means comprises a U-shaped member.

14. The product of claim 1, in which said stiffener means comprises a flat splice strip.

15. The electrode of claim 1, in which the riser is a copper cored titanium tube and the new electrode member has multiple coats of an electrically conductive electrocatalytic material fixed thereon by heating.

* * * * *

UNITED STATES PATENT OFFICE

CERTIFICATE OF CORRECTION

Patent No. 3,940,328 Dated Feb. 24, 1976

Inventor(s) VASELIOS H. THOMAS and GERALD R. POHTO

It is certified that error appears in the above-identified patent and that said Letters Patent are hereby corrected as shown below:

Cols.

7 and 8 Claims 9 to 15 line 1 of each "1" to --8--

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*